US005247950A

United States Patent [19]

Martin et al.

[11] Patent Number: 5,247,950

[45] Date of Patent: Sep. 28, 1993

[54] CONTROL OF STATIC BURNING RATE BY USE OF BINARY BURNIGN CHEMICAL COMBINATIONS

[75] Inventors: Richard H. Martin, Brevard; William F. Owens, Jr., Pisgah Forest; Gary W. Wise, Candler, all of N.C.

[73] Assignee: P. H. Glatfelter Company, Spring Grove, Pa.

[21] Appl. No.: 724,897

[22] Filed: Jul. 2, 1991

[51] Int. Cl.[5] ..... A24D 1/02

[52] U.S. Cl. ..... 131/365; 162/139

[58] Field of Search ..... 131/365; 162/139

[56] References Cited

U.S. PATENT DOCUMENTS

| | | |
|---|---|---|
| 3,744,496 | 7/1973 | McCarty et al. . |
| 4,231,377 | 11/1980 | Cline et al. . |
| 4,450,847 | 5/1984 | Owens . |
| 4,461,311 | 7/1984 | Mathews et al. . |
| 4,805,644 | 2/1989 | Hampl, Jr. et al. . |
| 4,881,557 | 11/1989 | Martin . |
| 4,915,118 | 4/1990 | Kaufman et al. . |

OTHER PUBLICATIONS

"Effect of Cigarette Paper on Smoke Yield and Composition" by Owens.

Published in *Recent Advances in Tobacco Science* vol. 4, Physical Parameters Which Effect the Composition of Cigarette Smoke, dated Oct. 30, 1978.

*Primary Examiner*—V. Millin

*Attorney, Agent, or Firm*—Kerkam, Stowell, Kondracki & Clarke

[57] ABSTRACT

Treating cigarette paper with (1) binary combinations of the sodium and potassium salts of a carboxylic acid or (2) binary combinations of an alkali metal chloride and an alkali metal carboxylate provides a means of controlling the static burning rate of cigarettes wrapped in these papers. Burn rate control is functionally implemented by varying (1) the sodium to potassium cation ratio at constant total alkali metal cation weight for the former binary combination and (2) the ratio of the alkali metal cation from the chloride to the alkali metal cation from the carboxylate at constant total alkali metal cation weight for the latter binary combination. This means of burn rate control is effective for cigarette papers containing various inorganic fillers and weighing less then 25 g/m$^2$ to over 45 g/m$^2$. Depending on the specific combination of salts, type cigarette paper and total alkali metal cation weight in the sheet, the static burning rate can be controlled over a range of 6 to 19 mg/min as the sodium/potassium ratio or alkali metal cation (from chloride)/alkali metal cation (from carboxylate) ratio is incrementally varied.

21 Claims, 15 Drawing Sheets

EFFECT OF POTASSIUM CHLORIDE
AND POTASSIUM CITRATE ON SBR
OF REDUCED SIDESTREAM
CIGARETTE PAPER
SBR (mg/min)
62.0
60.0
58.0
56.0
54.0
52.0
50.0
48.0
46.0
0.00/2.70
0.45/2.25
0.90/1.80
1.35/1.35
1.80/0.90
2.25/0.45
2.70/0.00
WEIGHT % K+(Cl) K+(Cit) IN SOLUTION EFFECT OF POTASSIUM CHLORIDE
AND POTASSIUM ACETATE ON SBR
OF REDUCED SIDESTREAM
CIGARETTE PAPER
SBR (mg/min)
62.0
60.0
58.0
56.0
54.0
52.0
50.0
48.0
46.0
0.00/0.00
0.45/2.25
0.90/1.80
1.35/1.35
1.80/0.90
2.25/0.45
2.70/0.00
WEIGHT% K+ (Cl) / K+ (Acet) IN SOLUTION EFFECT OF SODIUM CHLORIDE AND POTASSIUM CITRATE ON SBR OF REDUCED SIDESTREAM CIGARETTE PAPER
SBR (mg/min)
60.0
56.0
52.0
48.0
44.0
40.0
0.00/2.70
0.45/2.25
0.90/1.80
1.35/1.35
1.80/0.90
2.25/0.45
2.70/0.00
WEIGHT % Na+(Cl)/K+(Cit) IN SOLUTION EFFECT OF SODIUM CHLORIDE AND POTASSIUM ACETATE ON SBR OF REDUCED SIDESTREAM CIGARETTE PAPER
SBR (mg/min)
60.0
56.0
52.0
48.0
44.0
40.0
0.00/2.70
0.45/2.25
0.90/1.80
1.35/1.35
1.80/0.90
2.25/0.45
2.70/0.00
WEIGHT % Na+(Cl)/K+(Acet) IN SOLUTION EFFECT OF SODIUM CHLORIDE AND POTASSIUM MALATE ON SBR OF REDUCED SIDESTREAM CIGARETTE PAPER
SBR (mg/min)
60.0
56.0
52.0
48.0
44.0
40.0
0.00/2.70
0.45/2.25
0.90/1.80
1.35/1.35
1.80/0.90
2.25/0.45
2.70/0.00
WEIGHT % Na+ (Cl)/K+(Mal) IN SOLUTION EFFECT OF Na AND K CITRATES
ON SBR OF HEAVYWEIGHT
CIGARETTE PAPER
SBR (mg/min)
62.0
60.0
58.0
56.0
54.0
52.0
50.0
48.0
46.0
44.0
0.00/2.70
0.45/2.25
0.90/1.80
1.35/1.35
1.80/0.90
2.25/0.45
2.70/0.00
WEIGHT % Na+/K+ IN SOLUTION EFFECT OF Na AND K CITRATES
ON SBR OF NORMAL WEIGHT
CIGARETTE PAPER
SBR(mg/min)
61.0
60.0
59.0
58.0
57.0
56.0
55.0
54.0
53.0
52.0
0.00/2.70
0.45/2.25
0.90/1.80
1.35/1.35
1.80/0.90
2.25/0.45
2.70/0.00
WEIGHT % Na+/K+ IN SOLUTION

CONTROL OF STATIC BURNING RATE BY USE OF BINARY BURNIGN CHEMICAL COMBINATIONS

SUMMARY OF THE INVENTION

The purpose of this invention is to provide a cigarette paper which statically burns at an acceptable rate and produces a light-colored, well-formed ash when fabricated into a cigarette with a suitable tobacco column. More specifically, these desirable burning characteristics are achieved by incorporating into the cigarette paper either a binary combination of potassium and sodium carboxylate burning chemical salts, such as potassium and sodium citrate, or a binary combination of an alkali metal carboxylate salt and an alkali metal halide, such as potassium citrate and potassium chloride. Furthermore, use of these binary burning chemical combinations is particularly effective at total alkali cation levels in the sheet of 1% or greater.

PRIOR ART

The reduced sidestream smoke cigarette paper patents which pertain to magnesium oxide/hydroxide paper fillers, and which describe burning chemical types and levels are U.S. Pat. Nos. 4,231,377; 4,450,847; 4,881,557 and 4,915,118. These patents claim alkali metal acetates, citrates, nitrates, carbonates, and tartrates as burning chemical types at levels in the sheet ranging from 0.5% to 8.0% of the basis weight of the paper.

Other patents pertaining to reduced sidestream smoke cigarette papers are U.S. Pat. Nos. 4,461,311 and 4,805,644. These patents disclose the sodium and potassium salts of carbonic, formic, acetic, propionic, malic, lactic, glycolic, citric, tartaric, fumaric, oxalic, malonic, nitric, and phosphoric acids at levels in the sheet up to 25% of the basis weight of the paper.

BRIEF DESCRIPTION OF THE DRAWINGS

The invention will be described, in detail, in reference to the accompanying drawings wherein.

DETAILED DESCRIPTION OF THE INVENTION

Figure 1:
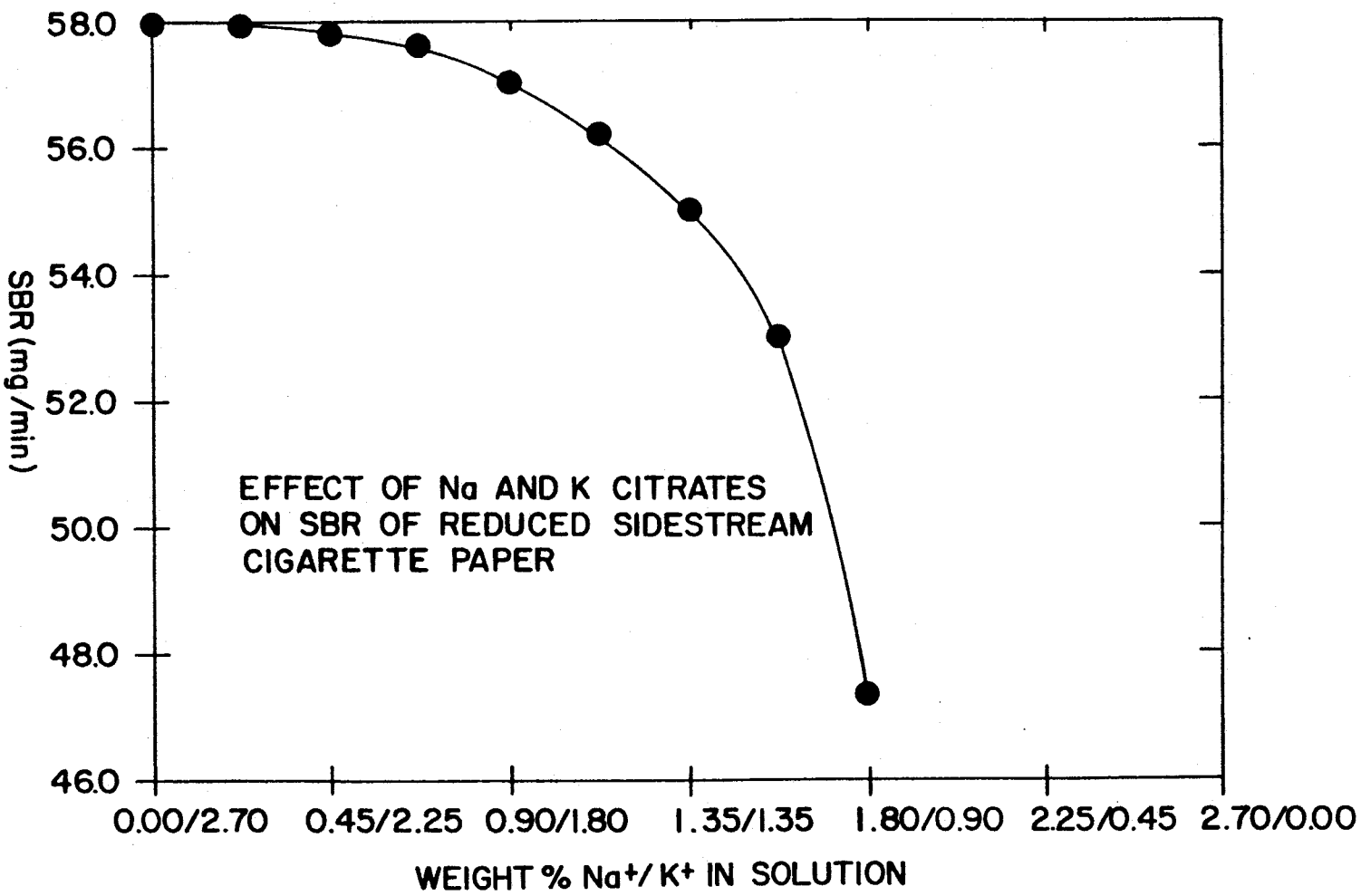
FIG. 1 illustrates the effect of the sodium/potassium cation ratio on cigarette static burning rate of reduced sidestream cigarette paper for mixed citrate burning chemicals.

In working with cigarette papers having basis weights ranging from 35 g/m$^2$ to 100 g/m$^2$, it was found that most viable papers exhibited fast static burning rates and, consequently, unacceptably low puff counts. These fast static burning rates are not unexpected, since heavyweight cigarette papers, regardless of filler type, simply incorporate more combustible cellulosic fiber (or fuel) per unit area of paper surrounding the smoldering tobacco column than does normal cigarette paper weighing 25 g/m$^2$. Thus, some unique means of retarding the static burning rate of heavyweight cigarette papers in a controlled manner was required to provide a sufficiently high puff count.

It was discovered that treating 45 g/m$^2$ reduced sidestream cigarette paper with a series of solutions containing either a binary combination of the sodium and potassium salts of a typical organic acid carboxylate burning chemical or a binary combination of the alkali metal salt of a typical organic acid carboxylate and an alkali metal chloride resulted in precise control of static burning rates over an extended range for cigarettes wrapped in these treated papers. The aqueous treating solutions for both burning chemical systems were prepared at constant total alkali metal cation concentrations of 0.7% by weight, and greater. The sodium cation from the carboxylate salt was varied in discrete increments from 0% to 100% of the fixed total alkali metal cation weight, while the potassium cation from the carboxylate salt was inversely varied in the same increments from 100% to 0% of the fixed total alkali metal cation weight. In the case of the second binary burning chemical system, the alkali metal cation from the halide salt was varied in discrete increments from 0% to 100% of the fixed total alkali metal cation weight, while the alkali metal cation from the carboxylate salt was inversely varied in the same increments from 100% to 0% of the fixed total alkali metal cation weight.

Heretofore, the static burning rate of a specific cigarette paper could not be controlled over an observed range of greater than 5 mg/min by the sole use of burning chemicals at the accepted, low treatment levels. Normally, significant changes in base sheet permeability were required to achieve a static burning rate change of 5 mg/min or more. This unexpectedly large effect on the static burning rate of cigarette paper prepared from the 45 g/m$^2$ basis weight magnesium hydroxide/calcium carbonate-filled cigarette paper treated with either a combination of potassium and sodium carboxylate burning chemicals or a combination of an alkali metal carboxylate and an alkali metal chloride is a unique phenomenon.

EXAMPLE 1

Reduced sidestream smoke cigarette paper, containing 10% magnesium hydroxide and 32% calcium carbonate fillers and having a basis weight of 45 g/m$^2$, was size-press treated with aqueous solutions of mixed potassium and sodium citrates. The total alkali metal cation (sum of potassium and sodium cations) in solution was 2.70% by weight for each solution with the sodium cation being varied in 0.45% increments from 0% to 2.70% and the potassium cation being inversely varied in 0.45% increments from 2.70% to 0%. Total alkali metal cation level in the treated cigarette papers ranged from 2.0 to 2.25 weight percent. Cigarettes were hand-rolled with these treated cigarette papers using tobacco columns from a commercial American blended cigarette routinely employed as a laboratory standard for low sidestream smoke cigarette paper smoking studies. Cigarette length was 60 mm, of which 47 mm was consumed during static burning rate measurements. Tobacco columns were weight-selected within the range of 0.91 to 0.93 grams and rerolled cigarettes conditioned for a minimum of 24 hours before smoking in a controlled humidity environment. Cigarette preparation, conditioning and smoking of test cigarettes was conducted in a smoking laboratory environmentally controlled to 72° F. and 62% R.H.

FIG. 1 presents the effect of the sodium/potassium cation ratio on cigarette static burning rate for mixed citrate burning chemicals. The test cigarettes wrapped in paper treated with more than 1.80% sodium citrate failed to sustain a static burn and thus self-extinguished. Nevertheless, the static burning rate varies systematically over an 11 mg/min mass burning rate range for cigarettes wrapped in the citrate-treated papers.

EXAMPLE 2

Reduced sidestream smoke cigarette paper, containing 10% magnesium hydroxide and 32% calcium carbonate fillers and having a basis weight of 45 g/m$^2$, was size-press treated with aqueous solutions of mixed potassium and sodium acetates. Paper and cigarettes were prepared and smoked in the same manner described in Example 1.

Figure 2:
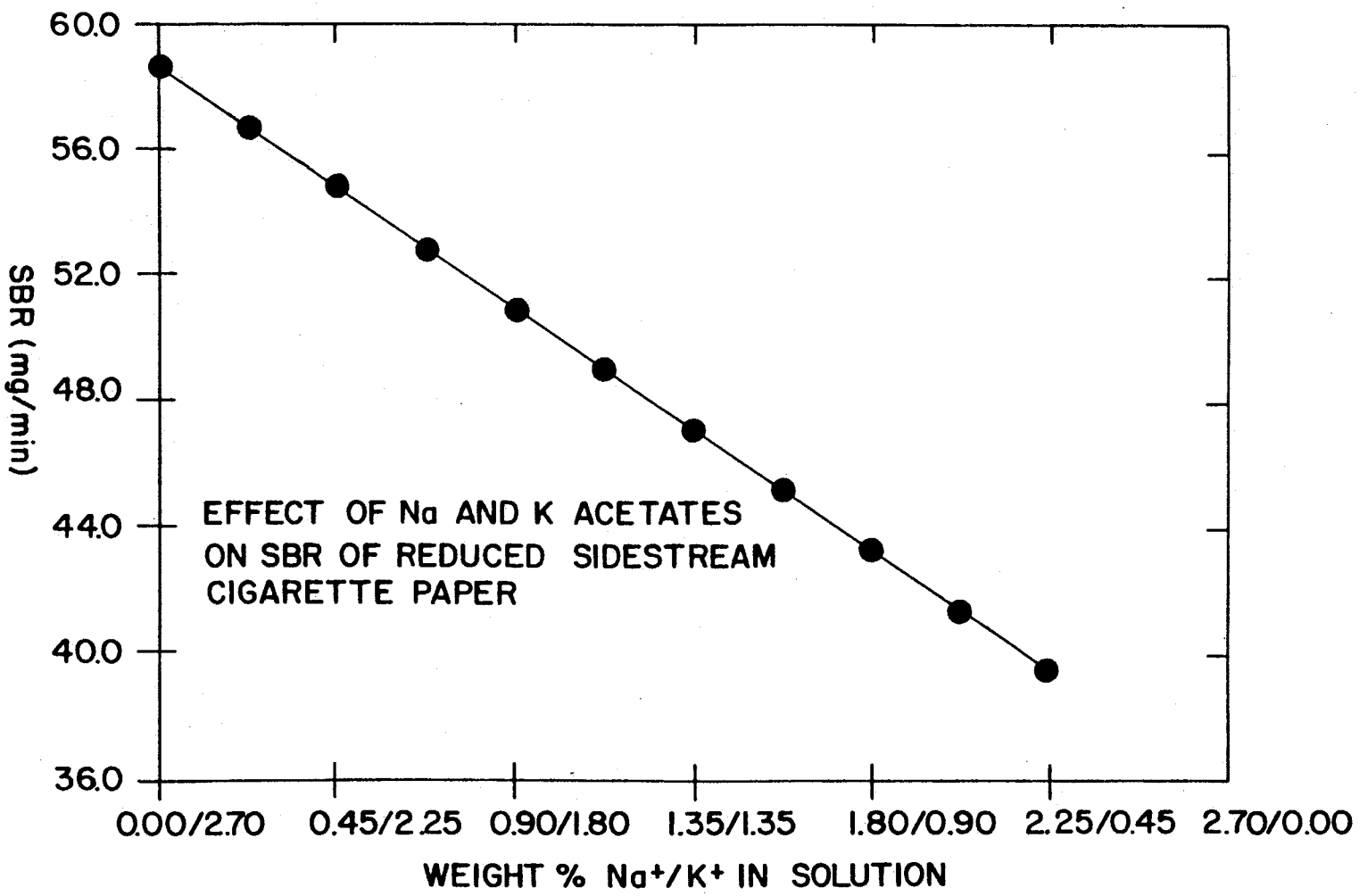
FIG. 2 illustrates the effect of the sodium/potassium cation ratio on cigarette static burning rate of reduced sidestream cigarette paper for mixed acetate burning chemicals.

FIG. 2 portrays the effect of the sodium/potassium cation ratio on cigarette static burning rate for mixed acetate burning chemicals. The cigarettes wrapped in paper treated with more than 2.25% sodium acetate failed to sustain a static burn and thus self-extinguished. The static burning rate varies linearly over the remarkably extended range of 19 mg/min for cigarettes wrapped in the acetate-treated papers.

EXAMPLE 3

Reduced sidestream smoke cigarette paper, containing 10% magnesium hydroxide and 32% calcium carbonate fillers and having a basis weight of 45 g/m$^2$, was size-press treated with aqueous solutions of mixed potassium and sodium malates. Paper and cigarettes were prepared and smoked in the same manner described in Example 1.

Figure 3:
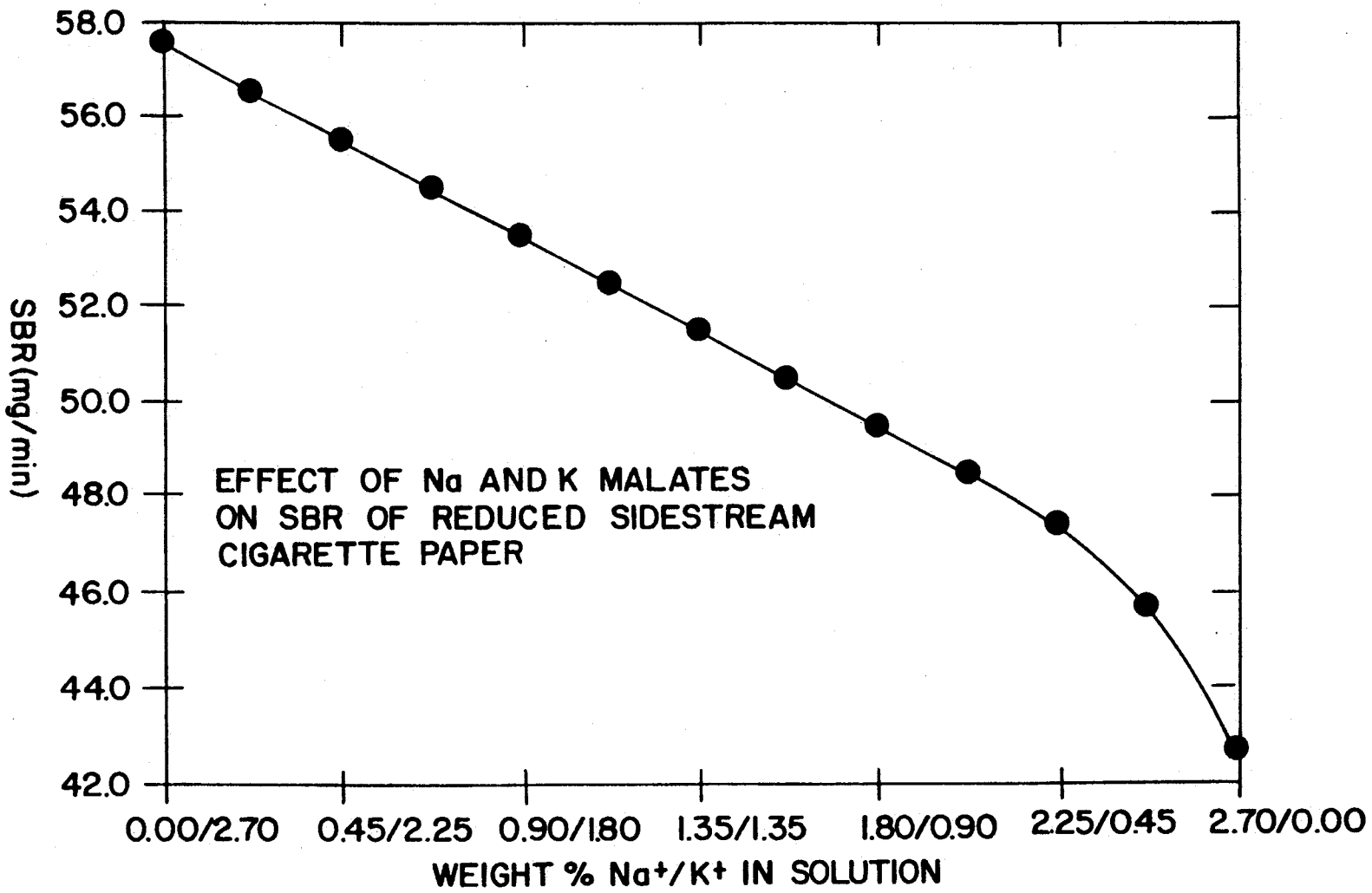
FIG. 3 shows the effect of the sodium/potassium ratio on cigarette static burning rate of reduced sidestream cigarette paper for mixed malate burning chemicals.

FIG. 3 shows the effect of the sodium/potassium ratio on cigarette static burning rate for mixed malate burning chemicals. The static burning rate varies systematically over a range of about 15 mg/min for the cigarettes wrapped in the malate-treated papers.

EXAMPLE 4

Alkali metal chlorides are thermally stable inorganic ash conditioners which serve to improve the formation of cigarette paper ash, exhibit little, if any, concentration effect on static burning rate and do not contribute undesirable decomposition products to either mainstream or sidestream smoke. Consequently, it is of interest to determine if a mixture of potassium and sodium chlorides would exhibit the same effect on static burning rate observed for mixtures of potassium and sodium carboxylate burning chemicals. Thus, reduced sidestream smoke cigarette paper containing 10% magnesium hydroxide and 32% calcium carbonate fillers, and having a basis weight of 45 g/m$^2$, was size-press treated with aqueous solutions of mixed potassium and sodium chlorides. Again, paper and cigarettes were prepared and smoked in the same manner described in Example 1.

Figure 4:
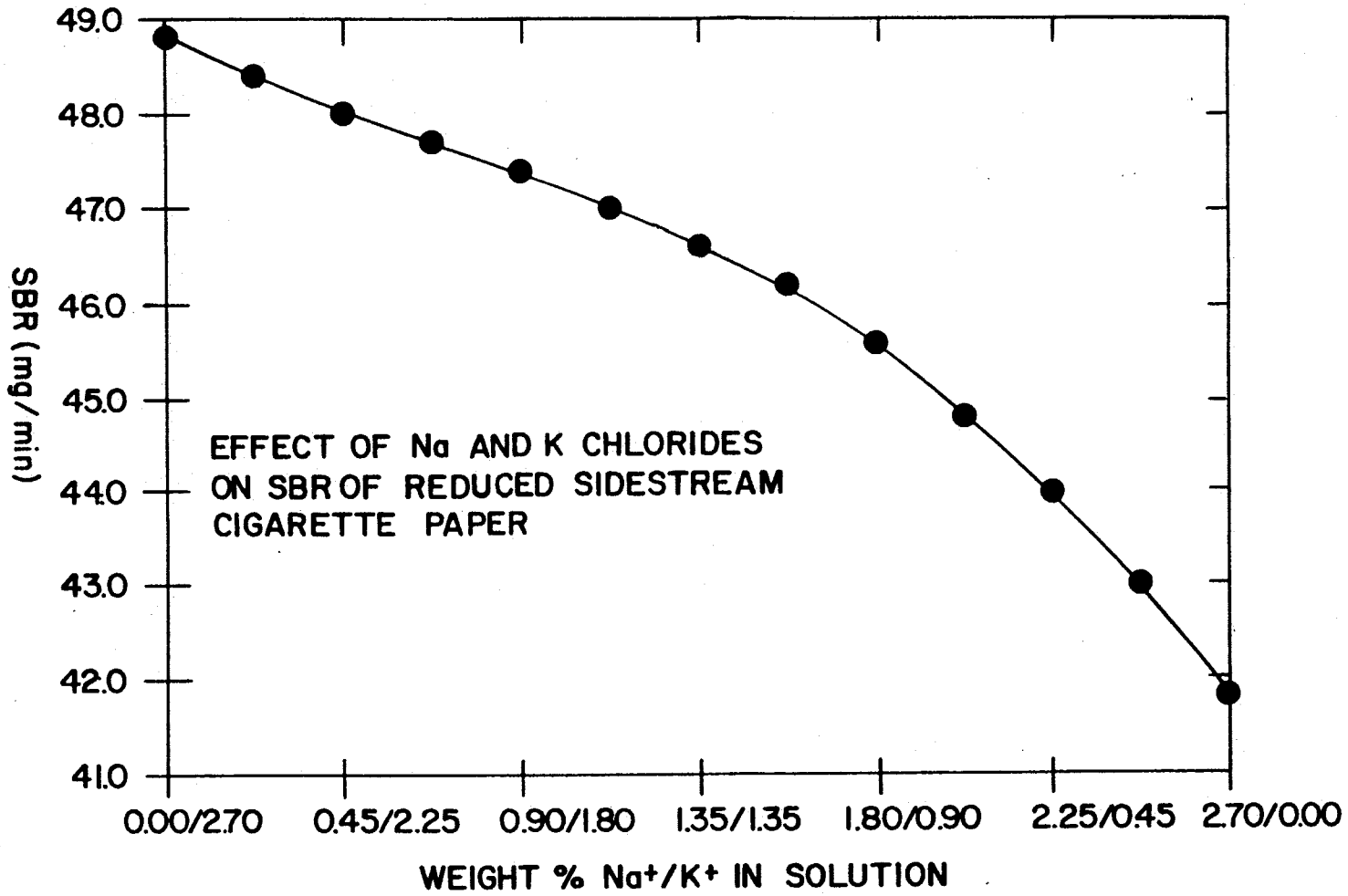
FIG. 4 illustrates the effect of the sodium/potassium ratio on cigarette static burning rate on reduced sidestream cigarette paper for mixed chloride ash conditioners.

FIG. 4 presents the effect of sodium/potassium ratio on cigarette static burning rate for mixed chloride burning chemicals. Once again, a pronounced effect is demonstrated, although of a lesser magnitude. Static burning rate varies in a regular manner over a range of 7 mg/min for those cigarettes wrapped in chloride-treated papers. EXAMPLES 5, 6 and 7

In order to demonstrate the effect of mixed potassium carboxylate and potassium chloride burning chemicals on static burning rate, three series of experiments were conducted using potassium citrate/potassium chloride, potassium acetate/potassium chloride and potassium malate/potassium chloride, respectively, as the binary burning chemical combinations. Reduced sidestream smoke cigarette paper, containing 10% magnesium hydroxide and 32% calcium carbonate fillers and having a basis weight of 45 g/m$^2$, was size-press treated with aqueous solutions of these three binary potassium carboxylate/chloride burning chemical combinations. Again, the total alkali metal cation (potassium ion) in solution was 2.70% by weight for each solution with the potassium ion from the chloride being varied in 0.45% increments from 0% to 2.70% and the potassium ion from the carboxylate being inversely varied in 0.45% increments from 2.70% to 0%. Cigarettes were prepared and smoked in the same manner described in Example 1.

Figure 5:
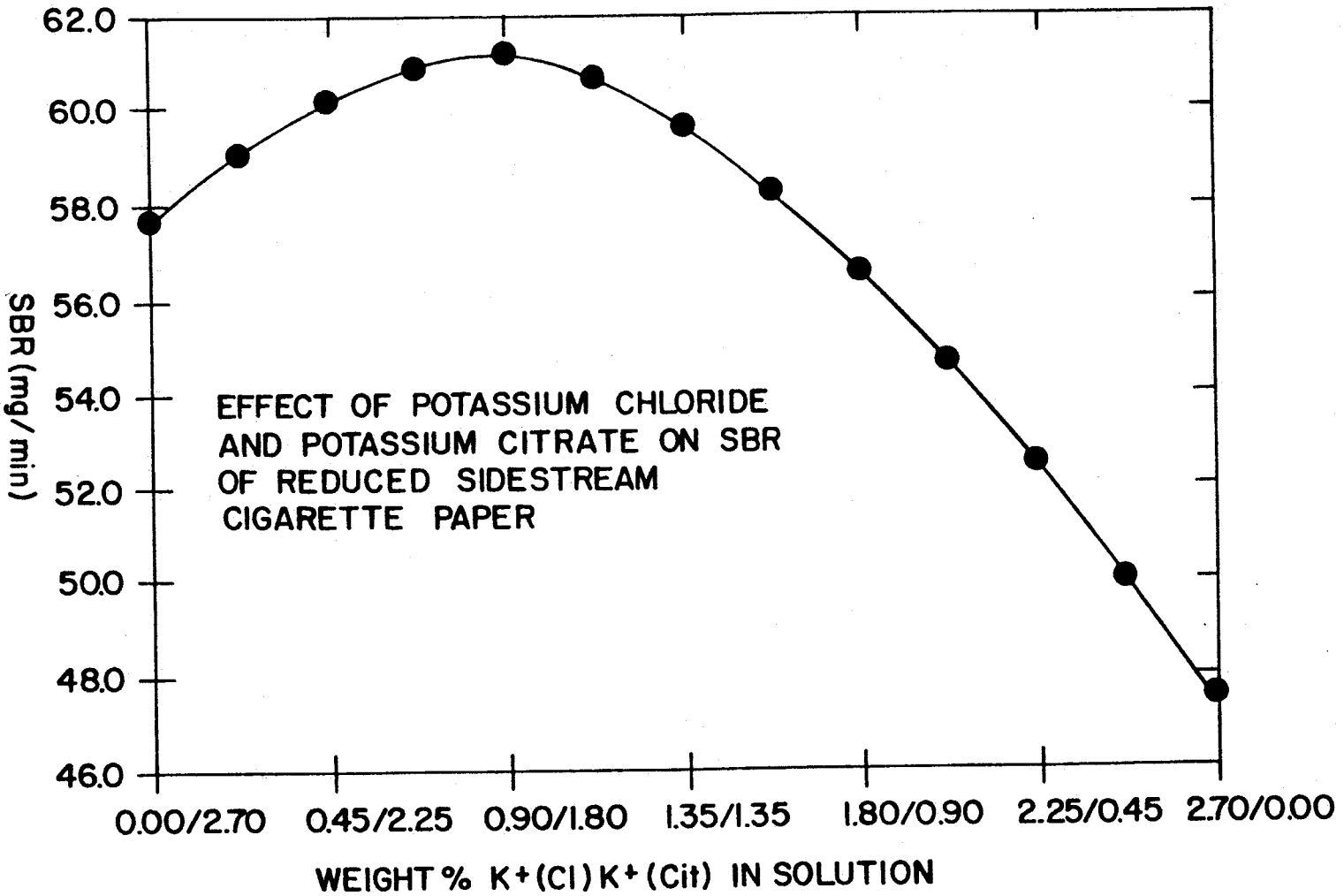
FIGS. 5, 6, and 7 portray the effects of mixed potassium citrate/potassium chloride, potassium acetate/potassium chloride and potassium malate/potassium chloride burning chemicals, respectively, on the static burning rate of the reduced sidestream smoke cigarette paper.
Figure 6:
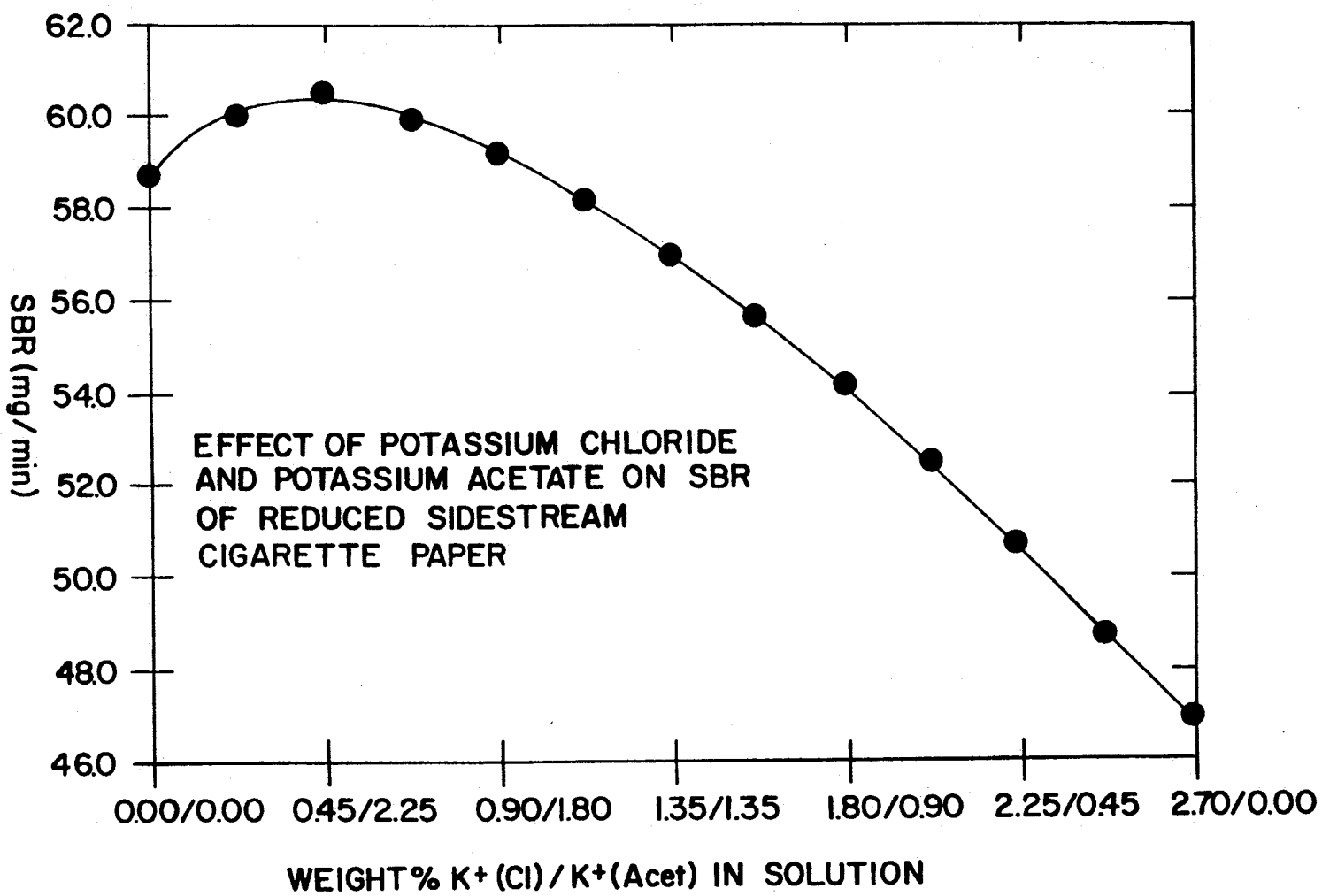
Figure 7:
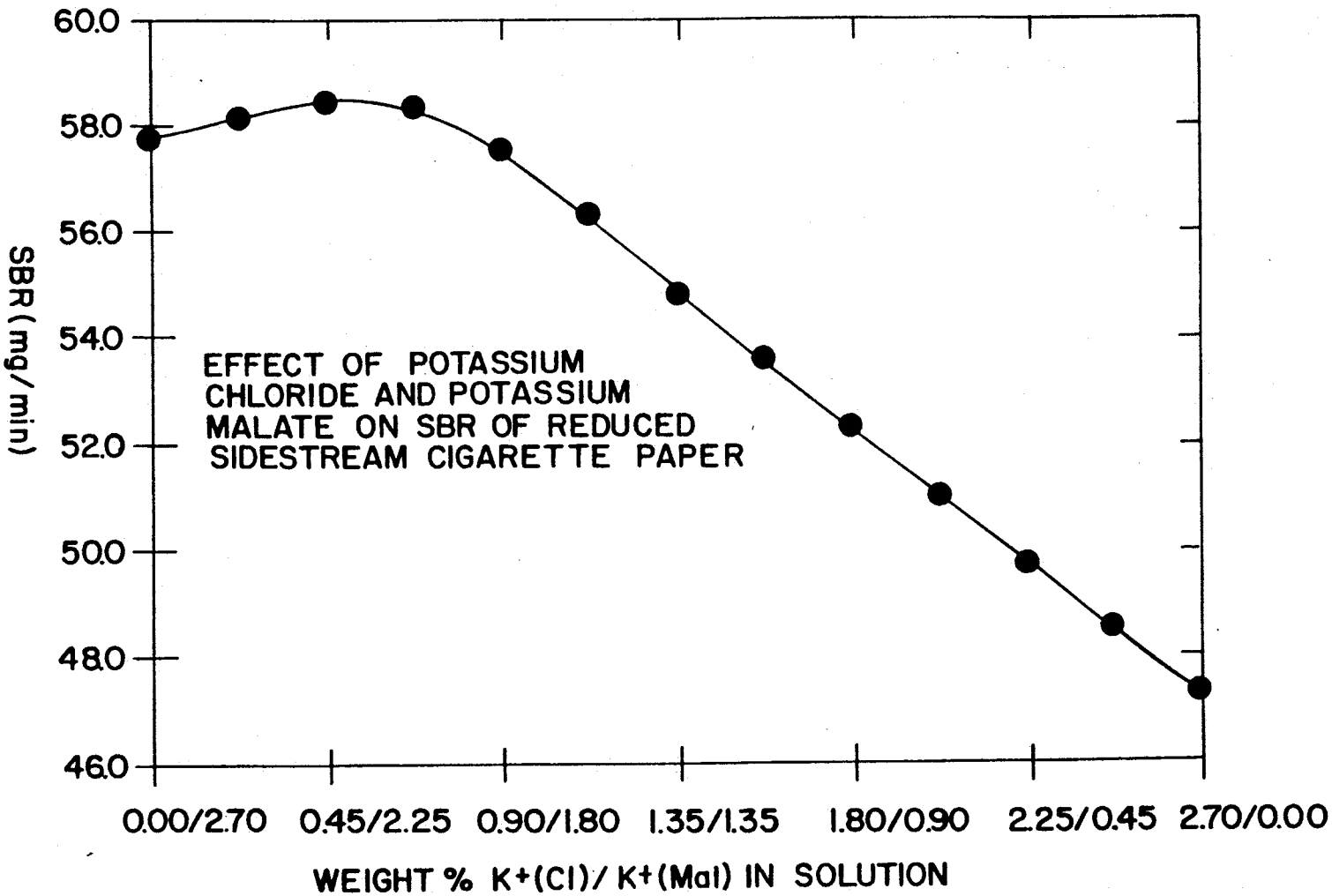

FIGS. 5, 6 and 7 portray the effects of the binary potassium citrate/potassium chloride, potassium acetate/potassium chloride and potassium malate/potassium chloride burning chemical combinations, respectively, on the static burning rate of the reduced sidestream smoke cigarette paper. The static burning rate varies systematically over the range of 11 to 14 mg/min. In all cases, the static burning rate increases slightly as the potassium ion from the chloride increases from 0% to 0.45% and then regularly decreases as the potassium ion from the chloride further increases to 2.70%. Thus, binary mixtures of potassium carboxylate and potassium chloride burning chemicals also offer an effective means of controlling static burning rate over an extended range.

EXAMPLES 8, 9 and 10

As a complement to Examples 5, 6 and 7 above, three series of experiments were conducted with sodium chloride replacing potassium chloride in the potassium carboxylate/alkali metal chloride binary burning chemical combination. The standard reduced sidestream smoke cigarette paper was sized in the manner described above with three series of solutions containing various ratios of the potassium citrate/sodium chloride, potassium acetate/sodium chloride and potassium malate/sodium chloride binary burning chemical combinations. Cigarettes were prepared and smoked by the standard procedures.

Figure 8:
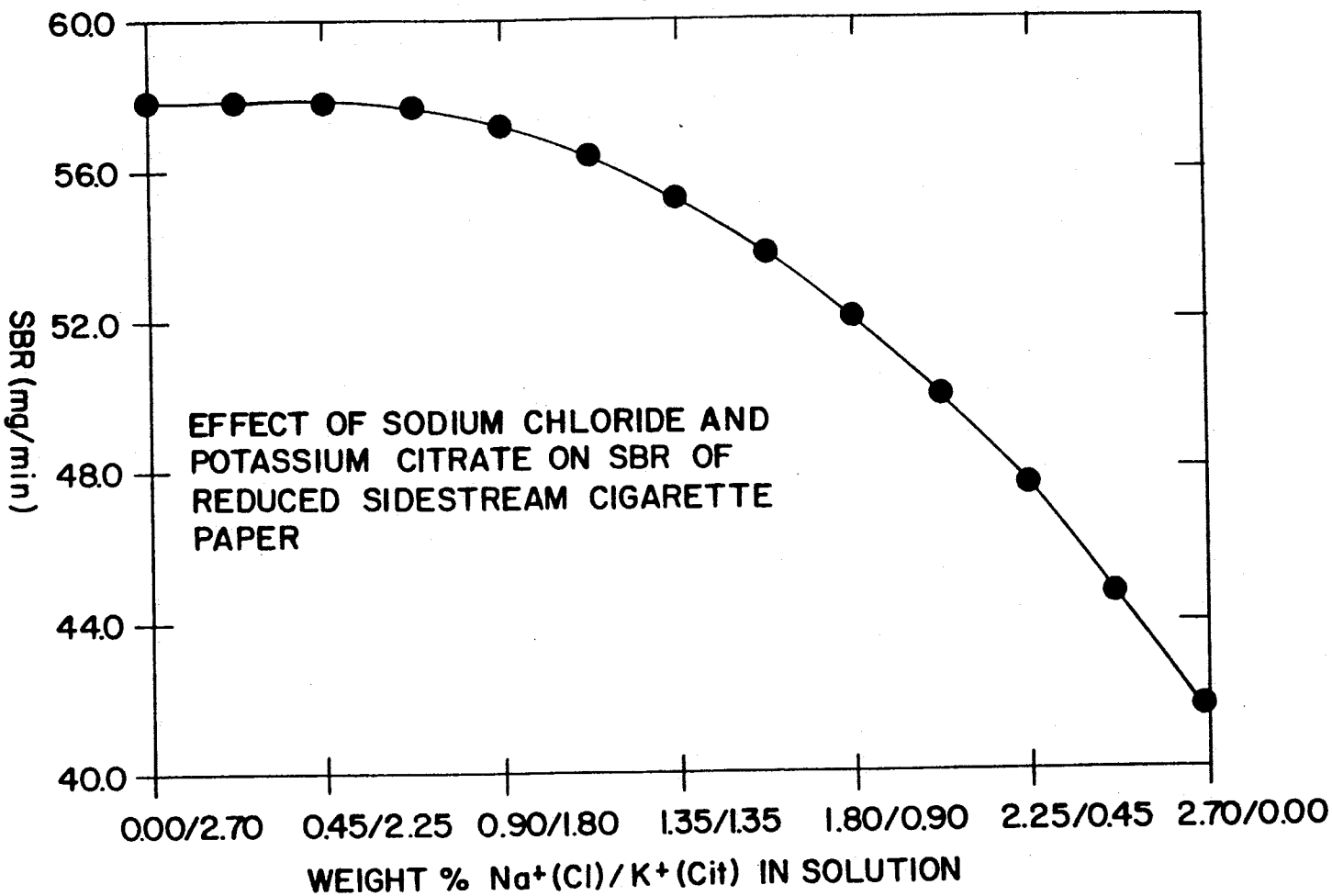
FIGS. 8, 9, and 10 show the effects of mixed potassium citrate/sodium chloride, potassium acetate/sodium chloride and potassium malate/sodium chloride burning chemicals, respectively, on the static burning rate of the reduced sidestream smoke cigarette paper.
Figure 9:
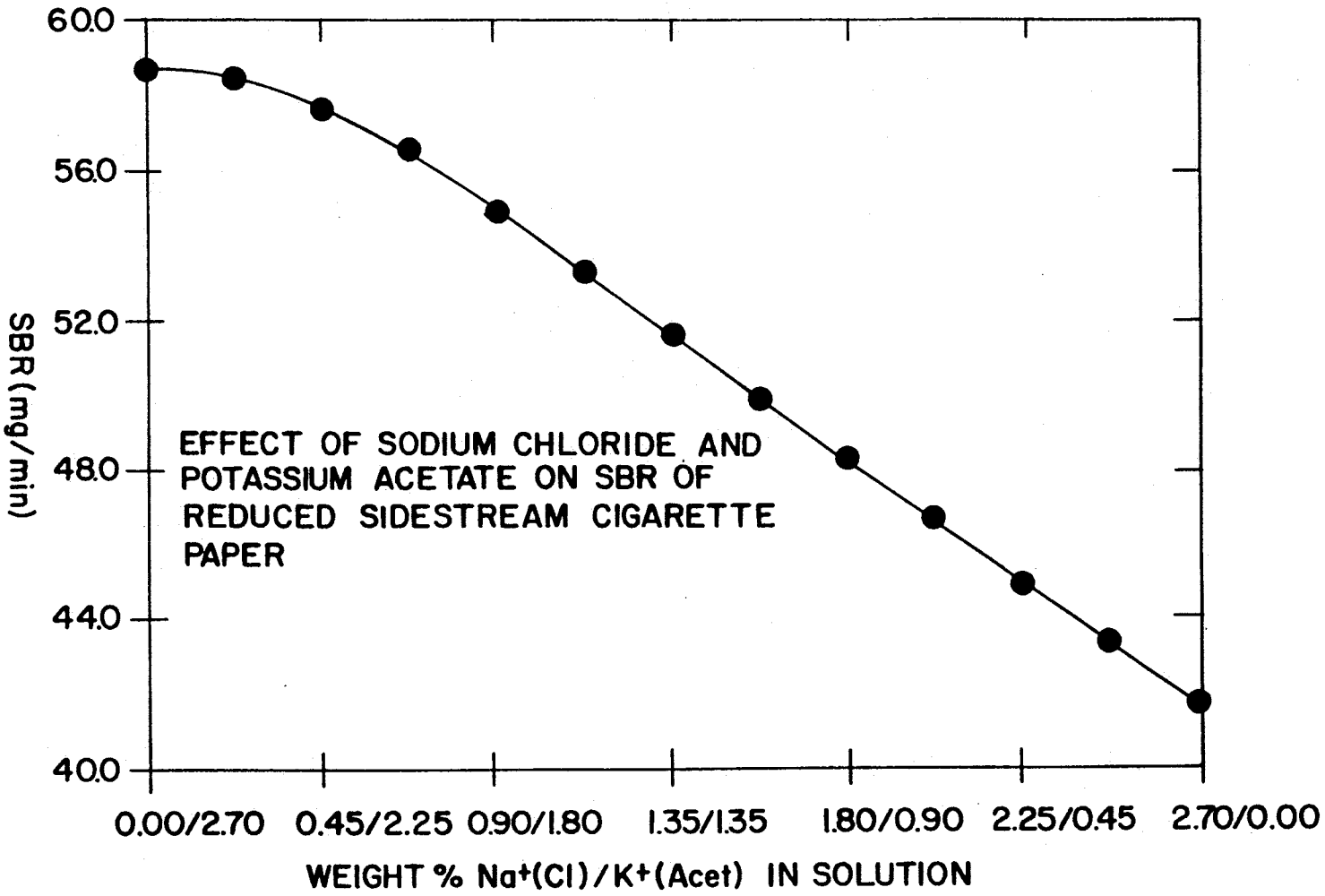
Figure 10:
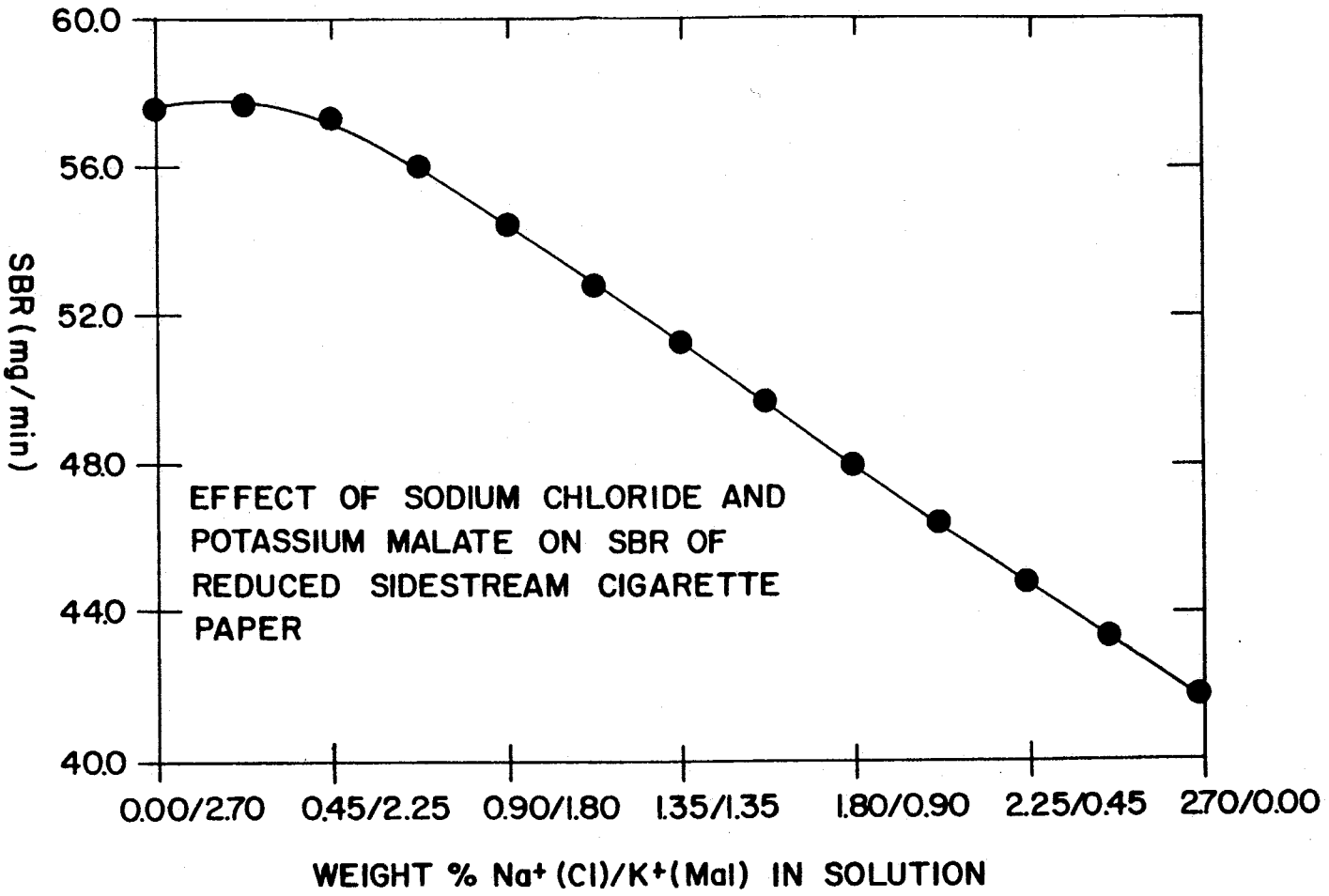

FIGS. 8, 9 and 10 show the effects of potassium citrate/sodium chloride, potassium acetate/sodium chloride and potassium malate/sodium chloride binary burning chemical combinations, respectively, on the static burning rate of the reduced sidestream smoke cigarette paper. The static burning rate varies systematically over the range of 16 to 17 mg/min. As expected, this range is greater than that exhibited by the equivalent potassium carboxylate/potassium chloride treated paper, since sodium chloride by itself intrinsically demonstrates a slower static burning rate than does potassium chloride. In addition, the potassium carboxylate/sodium chloride static burning rate curves do not exhibit the initial increase in burning rate that the potassium carboxylate/potassium chloride curves reveal. Thus, mixtures of potassium carboxylate and sodium chloride burning chemicals also provide an effective means of controlling the static burning rate of reduced sidestream smoke cigarette paper over a wide range of burning rates.

EXAMPLES 11 and 12

Two experiments were conducted to confirm that the effect of the sodium carboxylate/potassium carboxylate binary burning chemical combination on the static burning rate of cigarette paper is applicable to cigarette papers other than the 45 g/m$^2$ magnesium hydroxide-filled, reduced sidestream smoke cigarette paper. First, a 45 g/m$^2$ heavyweight cigarette paper, containing only 28% calcium carbonate filler and exhibiting a porosity of 8 CORESTA, was treated with a series of sodium citrate/potassium citrate sizing solutions in the manner described in Example 1. Secondly, a commercial 25 g/m$^2$ cigarette paper, containing 28% calcium carbonate filler and having an inherent porosity of 26 CORESTA, was likewise treated with the sodium citrate/potassium citrate binary burning chemical combination according to the procedure of Example 1. Cigarettes were then prepared and smoked in the same manner described in Example 1.

Figure 11:
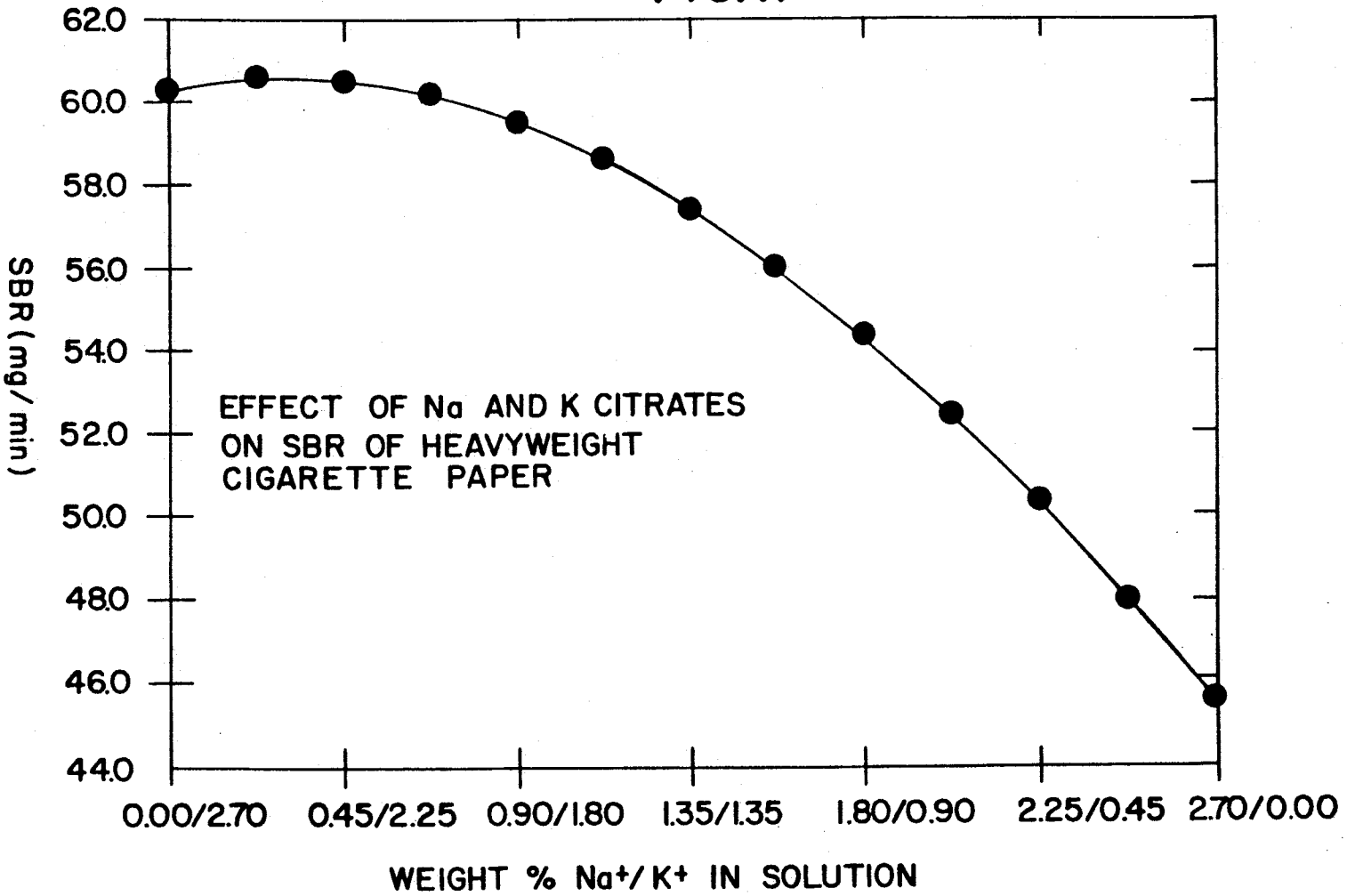
FIG. 11 illustrates the effect of the sodium/potassium cation ratio on the static burning rate of a 45 g/m$^2$ heavyweight cigarette paper for alkali metal citrate burning chemicals.

FIG. 11 presents the effect of the sodium/potassium cation ratio on the static burning rate of the 45 g/m$^2$ heavyweight cigarette paper for the citrate burning chemicals. The static burning rate varies systematically over a 14 mg/min range, which is similar to the range exhibited by the citrate-treated, reduced sidestream smoke cigarette paper. Thus, the effect of the sodium citrate/potassium citrate burning chemical combination on static burning rate applies to both heavyweight cigarette papers with normal filler and reduced sidestream smoke cigarette papers with magnesium hydroxide filler.

Figure 12:
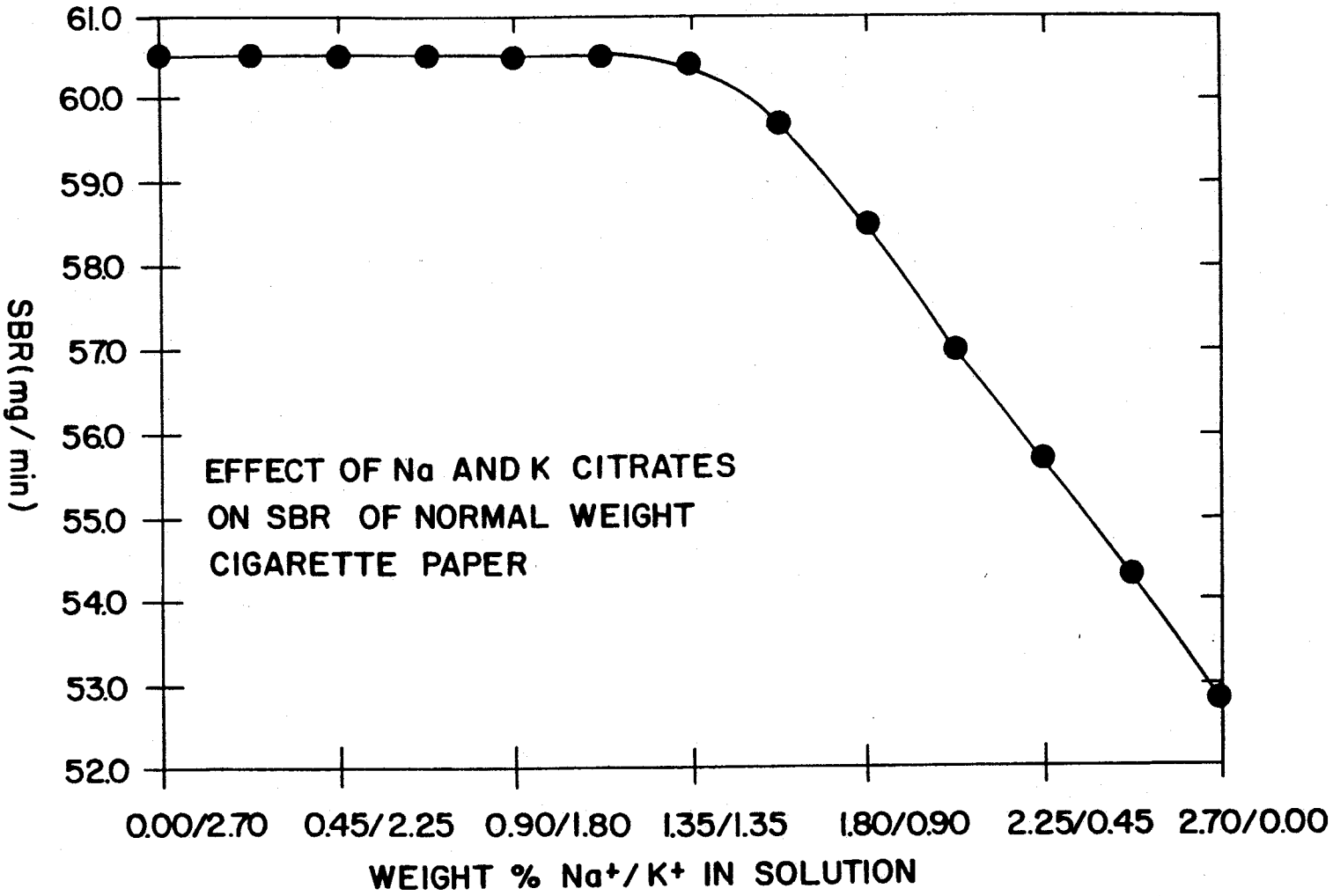
FIG. 12 shows the effect of the sodium/potassium cation ratio on the static burning rate of a 25 g/m$^2$ commercial cigarette paper for the alkali metal citrate burning chemicals.

FIG. 12 shows the effect of the sodium/potassium cation ratio on the static burning rate of the 25 g/m$^2$ commercial cigarette paper for the citrate burning chemicals. The static burning rate varies over a 7.8 mg/min range which is approximately 25/45th of the 15 mg/min range demonstrated by the heavyweight cigarette paper. Thus, it would appear that the effect of the sodium citrate/potassium citrate binary burning chemical combination on static burning rate is applicable to cigarette papers containing either calcium carbonate or magnesium hydroxide fillers which weigh 25 g/m$^2$ to 45 g/m$^2$ and greater, and, furthermore, that the magnitude of the static burning rate effect is dependent upon either sheet basis weight or the absolute weight of total burning chemical per unit area of paper.

EXAMPLES 13, 14 and 15

Three experiments were conducted to determine if the effect of the sodium carboxylate/potassium carboxylate binary burning chemical combination on the static burning rates of reduced sidestream smoke, heavyweight and normal weight cigarette papers occurs at total alkali metal cation levels lower than 2.70% by weight in solution. The size-press treatment solutions were prepared at a constant total alkali metal cation concentration of 1.40% by weight with the sodium cation being varied in 0.2% increments from 0% to 1.4% and the potassium cation being inversely varied in 0.2% increments from 1.4% to 0%. The reduced sidestream smoke cigarette paper used throughout this study, the heavyweight cigarette paper of Example 11, and the normal weight cigarette paper of Example 12 were size-press treated with these solutions. Cigarettes were then prepared and smoked in the manner described in Example 1.

Figure 13:
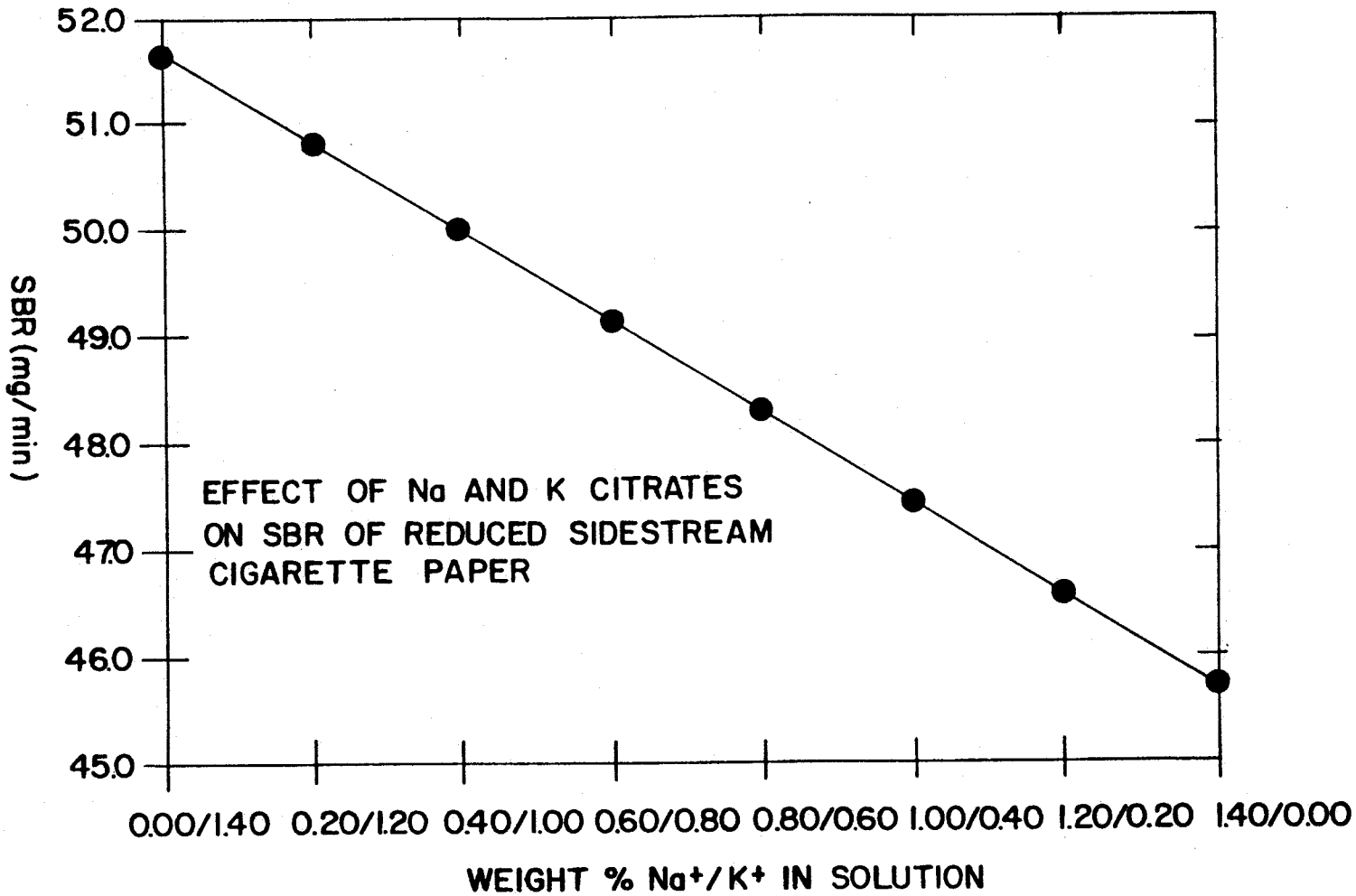
FIG. 13 shows the effect of the sodium/potassium cation ratio on the static burning rate of reduced sidestream smoke cigarette paper treated with a lower level of alkali metal citrates.

FIG. 13 shows the effect of the sodium/potassium cation ratio on the static burning rate of the reduced sidestream smoke cigarette paper treated with the lower level of alkali metal citrates. The static burning rate varies linearly over a 6 mg/min range, which is 45% less than the 11 mg/min range shown at the higher total alkali metal cation level in Example 1. This compares with the 48% reduction in total alkali metal cation level for the lower concentration treatment solution series.

Figure 14:
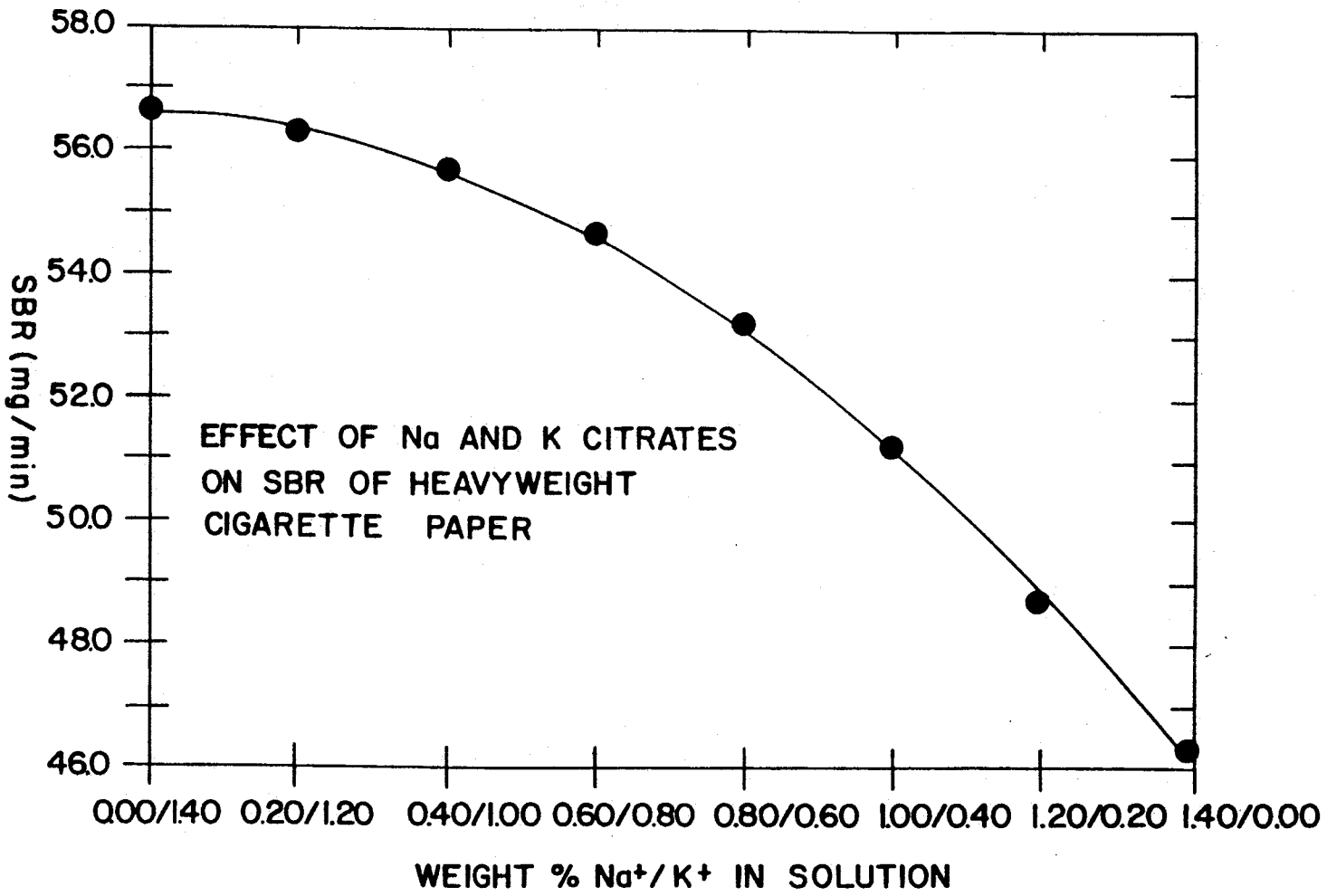
FIG. 14 illustrates the effect of the sodium/potassium cation ratio on the static burning rate of heavyweight cigarette paper treated with a lower level of alkali metal citrates.

FIG. 14 presents the effect of the sodium/potassium cation ratio on the static burning rate of heavyweight cigarette paper treated with the lower level of alkali metal citrates. The static burning rate varies regularly over a 10.3 mg/min range, which is 32% less than the 15.2 mg/min range exhibited at the higher total alkali metal cation level in Example 11.

Figure 15:
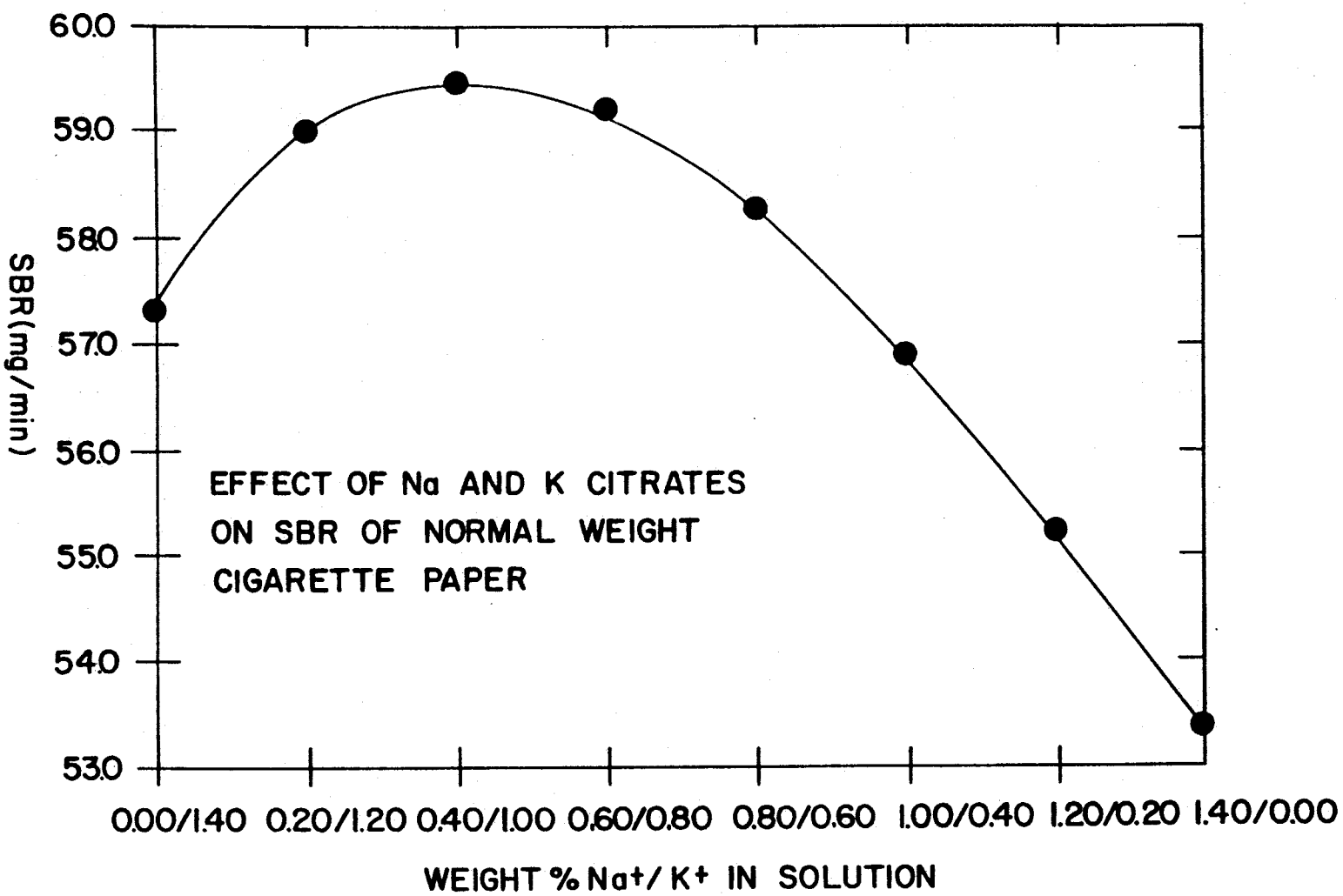
FIG. 15 illustrates the effect of the sodium/potassium cation ratio on the static burning rate of normal weight cigarette paper treated with a lower level of alkali metal citrates.

FIG. 15 presents the effect of the sodium/potassium cation ratio on the static burning rate of normal weight cigarette paper treated with the lower level of alkali metal citrates. The static burning rate varies regularly over a 6.2 mg/min range, which is only 21% less than the 7.8 mg/min range demonstrated at the higher total alkali metal cation level in Example 12.

Conclusion

Treating cigarette paper with (1) a mixture of the sodium and potassium salts of a carboxylic or inorganic acid by varying the sodium/potassium cation ratio at constant total alkali metal cation weight, or (2) a mixture of an alkali metal chloride and an alkali metal carboxylate by varying the ratio of the alkali metal cation from the chloride to the alkali metal cation from the carboxylate at constant total alkali metal cation weight, provides a novel means of precisely controlling the static burning rate of cigarettes wrapped in these papers. Depending on the specific combination of salts, static burning rate can be controlled over the range of 6 to 19 mg/min as the sodium/potassium ratio, or the alkali metal cation from chloride/alkali metal cation from carboxylate ratio is specifically varied. Furthermore, this effect is achieved at moderate levels of total alkali metal cation, 2.2% by weight, or less, in the sheet.

The effect of specific binary burning chemical combinations on static burning rate is applicable to both normal calcium carbonate-filled cigarette papers and calcium carbonate/magnesium hydroxide-filled cigarette papers, as well as to cigarette papers covering a broad range of basis weights (25 g/m$^2$ to greater than 45 g/m$^2$). This binary burning chemical combination effect on static burning rate appears to decrease with decreasing basis weight of the paper at constant total alkali metal cation concentration. Furthermore, this burning chemical effect on static burning rate decreases with decreasing total alkali metal cation concentration for each type of cigarette paper; however, the exact magnitude of this decrease varies with filler type and basis weight of the paper. Thus, normal weight (25 g/m$^2$) cigarette papers treated with an incremental sequence of binary burning chemical solutions containing less than 1% total alkali metal cation exhibit static burning rate ranges of less than 6 mg/min."

Although only citrate, acetate, malate and chloride examples are cited, the salts of a variety of organic and inorganic acids anions commonly employed as burning chemicals are expected to function in a like manner. Anions such as bicarbonate, carbonate, formate, propionate, lactate, glycolate, tartrate, fumarate, nitrate, oxalate, malonate, phosphate and succinate can be readily applied to this teaching. This list of anions is not exclusive, nor is the total alkali metal cation level limited to the 2.2% by weight, or less, cited above. Other commonly acceptable burning chemical anions and higher total alkali metal cation levels are expected to function in the same manner described in this disclosure.

We claim:

1. A wrapper for smoking articles, such as cigarettes, cigars, and the like, comprising a cellulosic fiber sheet which contains an inorganic filler, having incorporated in the sheet a binary set of burning chemical salts selected from a group consisting of potassium carboxylate and sodium carboxylate pairs and alkali metal carboxylate and alkali metal halide pairs, at total alkali metal cation levels in the sheet greater than 1% by weight, wherein the weight ratio of the alkali metal cation from the halide salt to the alkali metal cation from the carboxylate salt varies from 0.1 to greater than 10 at constant total alkali metal cation level in the sheet for the purpose of controlling the inherent burning rate of the sheet.

2. The wrapper, as defined in claim 1, wherein the anion of the potassium carboxylate salt, the sodium carboxylate salt and the alkali metal carboxylate salt is selected from a group consisting of acetate, citrate, formate, fumarate, glycolate, lactate, malate, malonate, oxalate, propionate, succinate and tartrate.

3. The wrapper, as defined in claim 1, wherein the cation of the alkali metal carboxylate is selected from a group consisting of potassium and sodium.

4. The wrapper, as defined in claim 1, wherein the alkali metal halide salt is selected from a group consisting of potassium chloride and sodium chloride.

5. The wrapper, as defined in claim 1, wherein the inorganic filler is selected from a group consisting of calcium carbonate, magnesium hydroxide and combinations thereof.

6. The wrapper, as defined in claim 1, wherein the basis weight of the sheet is from about 20 g/m$^2$ to 75 g/m$^2$.

7. The wrapper, as defined in claim 1, wherein the weight ratio of the sodium cation to the potassium cation from the carboxylate salt pair varies from 0.1 to greater than 10 at constant total alkali metal cation level in the sheet for the purpose of controlling the inherent burning rate of the sheet.

8. A smoking article, such as cigarettes, cigars, and the like, comprising a tobacco charge and a wrapper which is composed of a cellulosic sheet containing an inorganic filler, having incorporated in the sheet a binary set of burning chemical salts selected from a group consisting of potassium carboxylate and sodium carboxylate pairs and alkali metal carboxylate and alkali metal halide pairs, at total alkali metal cation levels in the sheet greater than 1% by weight, wherein the weight ratio of the alkali metal cation from the halide salt to the alkali metal cation from the carboxylate salt varies from 0.1 to greater than 10 at constant total alkali metal cation level in the sheet for the purpose of controlling the static burning rate of the smoking article.

9. The smoking article, as defined in claim 8, wherein the anion of the potassium carboxylate salt, the sodium carboxylate salt and the alkali metal carboxylate salt is selected from a group consisting of acetate, citrate, formate, fumarate, glycolate, lactate, malate, malonate, oxalate, propionate, succinate and tartrate.

10. The smoking article, as defined in claim 8, wherein the cation of the alkali metal carboxylate is selected from a group consisting of potassium and sodium.

11. The smoking article, as defined in claim 8, wherein the alkali metal halide salt is selected from a group consisting of potassium chloride and sodium chloride.

12. The smoking article, as defined in claim 8, wherein the inorganic sheet filler is selected from a group consisting of calcium carbonate, magnesium hydroxide and combinations thereof.

13. The smoking article, as defined in claim 8, wherein the basis weight of the sheet is from about 20 g/m$^2$ to 75 g/m$^2$.

14. The smoking article, as defined in claim 8, wherein the weight ratio of the sodium cation to the potassium cation from the carboxylate salt pair varies from 0.1 to greater than 10 at constant total alkali metal cation level in the sheet for the purpose of controlling the static burning rate of the smoking article.

15. A method for controlling the static burning rate of a smoking article and improving the ash formation properties which comprises wrapping a tobacco charge in a cellulosic sheet containing an inorganic filler, having incorporated in the sheet a binary set of burning chemical salts selected from a group consisting of potassium carboxylate and sodium carboxylate pairs and alkali metal carboxylate and alkali metal halide pairs, at total alkali metal cation levels in the sheet greater than 1% by weight, wherein the weight ratio of the alkali metal cation from the halide salt to the alkali metal cation from the carboxylate salt varies from 0.1 to greater than 10 at constant total alkali metal cation level in the sheet for the purpose of providing the claimed control of static burning rate.

16. The method, as defined in claim 15, wherein the anion of the potassium carboxylate salt, the sodium carboxylate salt and the alkali metal carboxylate salt is selected from a group consisting of acetate, citrate, formate, fumarate, glycolate, lactate, malate, malonate, oxalate, propionate, succinate and tartrate.

17. The method, as defined in claim 15, wherein the cation of the alkali metal carboxylate is selected from a group consisting of potassium and sodium.

18. The method, as defined in claim 15, wherein the alkali metal halide salt is selected from a group consisting of potassium chloride and sodium chloride.

19. The method, as defined in claim 15, wherein the inorganic sheet filler is selected from a group consisting of calcium carbonate, magnesium hydroxide and combinations thereof.

20. The method, as defined in claim 15, wherein the basis weight of the sheet is from about 20 $g/m^2$ to 75 $g/m^2$.

21. The method, as defined in claim 15, wherein the weight ratio of the sodium cation to the potassium cation from the carboxylate salt pair varies from 0.1 to greater than 10 at constant total alkali metal cation level in the sheet for the purpose of providing the claimed control of static burning rate.

* * * * *